US006608438B2

(12) United States Patent
Topelberg et al.

(10) Patent No.: US 6,608,438 B2
(45) Date of Patent: Aug. 19, 2003

(54) 3-D FLEXIBLE DISPLAY STRUCTURE

(75) Inventors: Rafael Topelberg, Ramat Gan (IL); Felix Guberman, Beer Sheva (IL)

(73) Assignee: Visson IP LLC, Dover, DE (US)

( * ) Notice: Subject to any disclaimer, the term of this patent is extended or adjusted under 35 U.S.C. 154(b) by 78 days.

(21) Appl. No.: 09/986,655

(22) Filed: Nov. 9, 2001

(65) Prior Publication Data

US 2003/0090200 A1 May 15, 2003

(51) Int. Cl.[7] ..... H01J 1/62; H01J 63/04
(52) U.S. Cl. ..... 313/511; 313/491
(58) Field of Search ..... 313/511, 505, 313/491, 584, 631

(56) References Cited

U.S. PATENT DOCUMENTS 3,571,647 A * 3/1971 Robinson
3,786,307 A * 1/1974 Robinson
3,792,308 A * 2/1974 Ota
3,803,437 A * 4/1974 Robinson
3,819,973 A * 6/1974 Hosford
4,855,190 A * 8/1989 Bezner
4,923,288 A * 5/1990 Allen et al.
5,128,662 A * 7/1992 Failla
5,399,502 A * 3/1995 Friend et al.
5,463,279 A * 10/1995 Khormaei
5,469,020 A * 11/1995 Herrick
5,485,355 A * 1/1996 Voshoboinik et al.
5,962,967 A 10/1999 Kiryuschev et al.
6,229,265 B1 5/2001 Schroeder-Perry et al.

FOREIGN PATENT DOCUMENTS

WO WO 99/19858 A1 4/1999

OTHER PUBLICATIONS

Patent Abstracts of Japan: Application No. 11–205814; Applicant: Sony Corp; date of filing: Jul. 21, 1999; Title: "Display Device".

* cited by examiner

*Primary Examiner*—Gary Paumen
(74) *Attorney, Agent, or Firm*—Browdy and Neimark, P.L.L.C.

(57) ABSTRACT

An electro-optical display comprising a flexible three-dimensional structure including at least two layers of electrode structures held together but spaced apart by at least one skeletal layer formed of fibers transverse to the electrode structures, the skeletal layer having empty space among the transverse fibers filled with an electrooptically active (EOA) substance, whereby an EOA zone is formed by the EOA substance between the electrode structures. A 3-D spacer fabric comprising two woven or knitted network layers united by a skeletal layer made of fibers and interwoven with the network layers, wherein the network layers comprise sets of conductive fibers ready to form an EOA zone with an EOA substance in the skeletal layer.

21 Claims, 6 Drawing Sheets

3-D FLEXIBLE DISPLAY STRUCTURE

FIELD OF THE INVENTION

This invention relates to flexible electro-optic displays, in particular to displays based on flexible fabrics and other flexible permeable materials.

BACKGROUND OF THE INVENTION

An electro-optic display is a device that changes its optical state when electric or electromagnetic signals are applied to it. The display may change as a whole unit or in parts constituting a visible image. The image on such displays is formed from a plurality of display elements including an electro-optically active (EOA) substance. "EOA substance" shall mean here a substance that changes its color, transparency, reflectivity or other optic properties, or emitting light, when subjected to changes of electric or electromagnetic field.

Flexible electro-optic displays may be made of flexible polymer films, where the EOA substance and patterns of electrodes are laid in thin layers over a polymer substrate, or may be based on flexible fibers or strips woven or knitted into fabric or textile material where the electrodes are in the constituent fibers. Woven displays have certain advantages since they may be produced using known weaving techniques which do not limit their length. Woven displays are more flexible and robust than integral film displays.

U.S. Pat. No. 5,962,967 and JP 2001-034195 disclose woven displays made of two sets of transverse fibers, each fiber including a longitudinal conductor, and at least fibers of one set including a coating of light-emitting or other EOA substance. At each junction where a fiber of one set overlaps a fiber of the other set, an EOA zone is formed from the EOA substance between the fibers. Each EOA zone is an individually controllable display element (pixel). The visible images are formed from a plurality of such pixels. The EOA zones (pixels) in such displays are of the size of the fiber diameter.

WO 99/19858 describes a woven display produced from flat fibers or strips in basket weave. The display comprises two intersecting sets of stripes. One of these sets may consist of display stripes with electroluminescent layer, while the other set consists of conductive stripes, or both sets may comprise display stripes and conductive stripes. The display stripes have a back conductive layer laid in separated areas defining display elements (pixels). The pixels effectively use the entire area of the applied electroluminescent layer.

U.S. Pat. No. 6,229,265 discloses a rigid electroluminescent display with display elements of EOA substance laid in grooves. The grooves are made in a common base electrode while individual electrodes are very narrow strips integral with a transparent layer covering the base electrode and the EOA substance.

SUMMARY OF THE INVENTION

In accordance with one aspect of the present invention, there is provided an electro-optical display comprising a flexible three-dimensional structure including at least two layers of electrode structures, which are held together but spaced apart by at least one skeletal layer formed of fibers transverse to the layers of electrode structures. The skeletal layer has empty space among the transverse fibers, filled with an electrooptically active (EOA) substance, whereby an electrooptically active zone (EOA zone) is formed by the EOA substance between the electrode structures. The 3D structure preferably comprises network layers made of fibers, or flexible film layers which carry the electrode structures, and are secured to the fibers of the skeletal layer.

The network layers may be formed of a plurality of woven or knitted fibers, or of a plurality of overlapping (non-woven) fibers. Hereinafter, a "fiber" shall mean any elongated and flexible element capable of being woven or knitted or sewn. A fiber may have round, flat, or other cross-section form. The electrode structures may be formed of flexible conductive layers or of conductive fibers. Hereinafter, a "conductive fiber" shall mean any elongated flexible element suitable for conducting electricity. For example, it may have round, flat or other section form; be made of solid metal; be in the form of a dielectric fiber or strip covered or intertwined with a conductive wire or layer; multiple-core twisted, spun, plaited wire; etc.

The network layers of the flexible 3-D display structure of the present invention may be made of a plurality of woven or knitted fibers, where in each network layer are interwoven non-conductive fibers protruding from one or both sides thereof in the form of Velcro hooks and loops or plush pile, and the skeletal layer is formed by the hooks and loops or the pile of two network layers snapped together.

In the electro-optical display of the present invention, the EOA zone may comprise a plurality of distinctive display elements constituting an image. According to one embodiment, the display elements are formed by separated areas of EOA substance or by areas of EOA substance with different electro-optic properties. According to another embodiment, a first electrode structure is formed from separated areas with individual wiring, and these areas, together with a second electrode structure, constitute display elements.

According to still another embodiment of the invention, the electrode structures are made of sets of conductive fibers interwoven with the network layers which are made of woven or knitted fibers. One electrode structure may comprise a first set of parallel conductive fibers, and another electrode structure may comprise a second set of parallel conductive fibers transverse to the first set. Thereby the EOA zone is constituted by a matrix of individually controllable EOA zones (pixels), each defined in the overlapping of a conductive fiber of the first set with a conductive fiber of the second set.

According to a further embodiment of the invention, the electrode structure may further comprise a conductive transparent or translucent layer in contact with the set of parallel conductive fibers. This layer may be in the form of separated strips parallel to the conductive fibers, each strip being in contact with at least one conductive fiber; or the layer may be continuous but of predetermined limited conductivity, such that the effective electric field of each conductive fiber is expanded over a strip of predetermined width disposed along said fiber. When a second conductive layer is applied to a second transverse electrode structure in a similar manner, a matrix of individually controllable enlarged pixels is formed, each pixel being defined in an overlapping of two transverse strips.

According to another aspect of the present invention, there is provided a three-dimensional spacer fabric comprising at least two woven or knitted network layers spaced by a skeletal layer made of non-conductive fibers predominantly transverse to and interwoven with the network layers, wherein the network layers comprise conductive fibers. The conductive fibers in one network layer may be arranged in a conductive network or in a set of parallel fibers. The two network layers may have transverse sets of parallel fibers adapted for forming a matrix structure. Each network layer may further comprise a second set of conductive fibers transverse to and in contact with the first set of parallel conductive fibers, where the fibers of the second set have a lower predetermined conductivity than the fibers of the first set and play the role of the above-mentioned layer with limited conductivity.

The 3-D structure of the present invention can be easily produced by known warp-knitting process. Not only the 3-D structure but also the electrode structure may be manufactured in the same time by the same process. The present invention allows for the manufacture of multi-layered 3-D display structures which can be used i.e. for two-sided displays. The EOA substance is very reliably accommodated in the skeletal layers of the structure due to the numerous surfaces of contact and adhesion. The thickness of the skeletal layer and hence of the EOA layer is not limited by the thickness of the constituent fibers as in the prior art. The electrode structures are reliably kept at predetermined distance from each other thus preventing electrical breakdown of the display.

BRIEF DESCRIPTION OF THE DRAWINGS

In order to understand the invention and to see how it may be carried out in practice, preferred embodiments will now be described, by way of non-limiting example only, with reference to the accompanying drawings, in which.

DETAILED DESCRIPTION OF THE INVENTION

Figure 1:
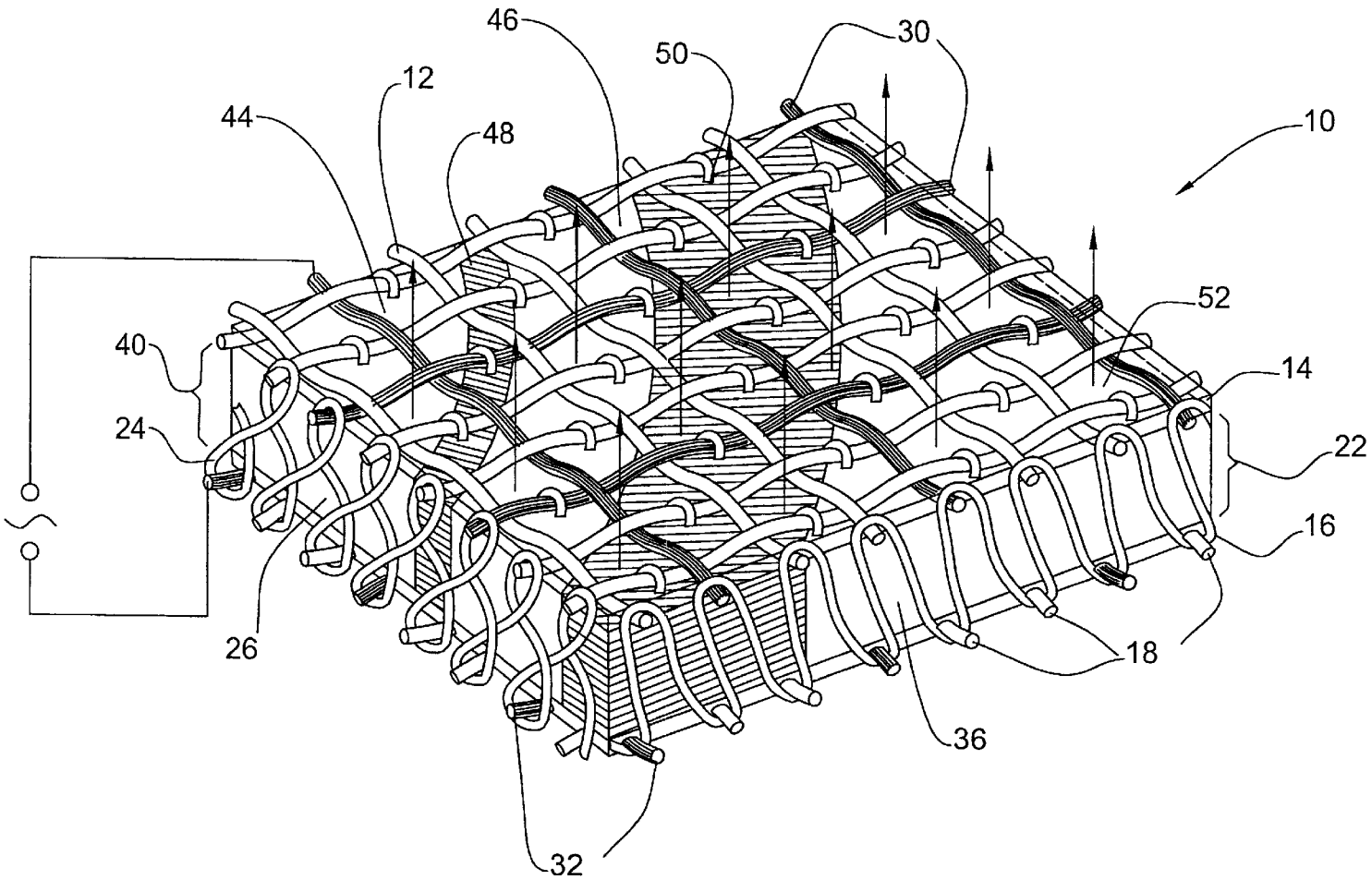
FIG. 1 is a perspective view of a generalized 3-D structure of an electro-optical display of the present invention.

With reference to FIG. 1, there is shown in a perspective sectional view an electro-optical display 10 of the present invention. It comprises a flexible three-dimensional structure 12 built of generally parallel flat network layers 14 and 16 made of fibers 18, and a skeletal layer 22 formed preferably of non-conductive fibers 24, having empty space 26 therebetween. The fibers 24 may be also conductive, as far as they do not shortcut the electrode structures below.

The network layers 14 and 16 carry electrode structures 30 and 32 integrated therewith. The electrode structures are made of individual conductive-fibers or of conductive fiber networks as shown in FIG. 1. They also may be in the form of a transparent or translucent conductive layer or a combination of a conductive layer and conductive fibers.

The empty space 26 of the skeletal layer 22 is filled with EOA substance 36, in intimate contact with the electrode structures 30 and 32. Thus, an EOA zone 40 is formed between the electrode structures 30 and 32. Upon applying a suitable electric signal on electrodes 30 and 32, the EOA substance therebetween will change its optic properties, i.e. may emit light in the case of electroluminescent substance.

The skeletal layers may be more than one, each skeletal layer being sandwiched between a pair of adjacent network layers (see FIGS. 6 and 10 below). Such structure may be used for a two-sided display or a light-transmissive display.

Preferably, the network layers are made of polymer material but may be made also of inorganic fibers. The skeletal layers have plenty of penetrable space between their fibers and are adapted to generally preserve a predetermined distance between the network layers when the whole flexible display 10 is bent, rolled, etc.

The EOA substance in the skeletal layer may be laid as areas 44 and 46 separated by gaps 48 filled with optically inactive substance, or as areas 46, 50 and 52 having different electro-optic properties, for example, different color. These areas represent distinctive display elements forming a static image when a suitable electric signal is applied to the electrode structures 30 and 32.

Figure 2A:
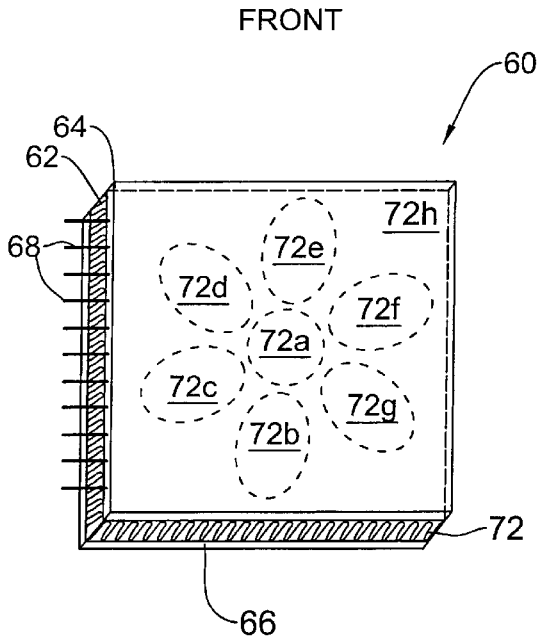
FIGS. 2A and 2B are front and back plan views of an animated display structure in accordance with the present invention.
Figure 2B:
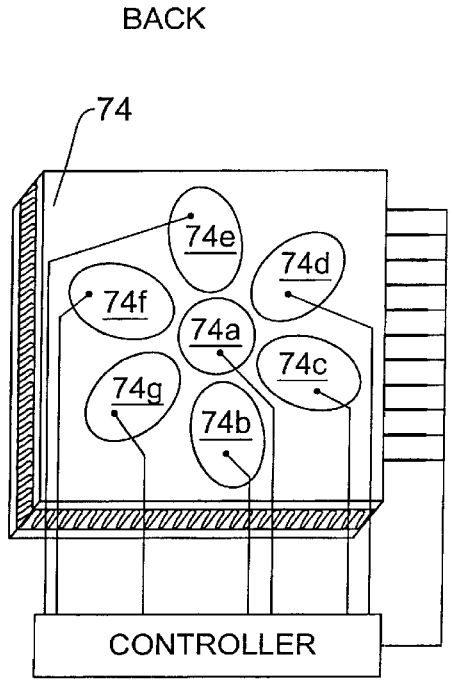

The electrode structures also may have separated conductive areas with individual wiring, as illustrated by the front and back views in FIGS. 2A and 2B. Here, a 3-Delectrooptic display 60 comprises one skeletal layer 62 sandwiched between a front transparent network layer 64 and a back network layer 66. A front electrode structure 68 is integrated in the front layer 64. An EOA substance 72 fills the skeletal layer 62 being laid therein in areas 72*a* to 72*h* of different color. A rear electrode structure 74 is applied on the back network layer 66 in separated areas 74*a* to 74*g*.

The conductive areas 72*a* to 72*g* generally coincide, in plan view, with the respective EOA substance areas 72*a* to 72*g*, thereby forming a display element between each conductive area 74 and the front electrode structure 68. Using a suitable wiring and controller, the display elements may be switched on and off in a desired order, thus forming a dynamic image. It should be understood that the electrooptic display 60 will work also in the case when the boundaries of the areas of EOA substance 72*a* to 72*g* do not coincide with the boundaries of the areas of the rear electrode structure 72*a* to 74*g*.

Figure 3:
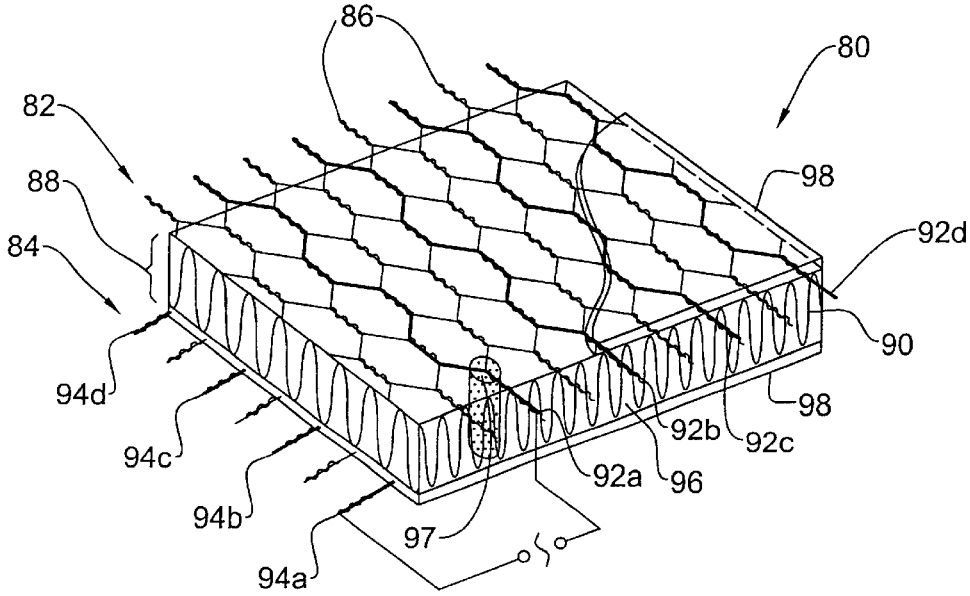
FIG. 3 is a perspective view of an electro-optical display structure based on 3-D spacer fabric.

The skeletal layers are preferably made of non-conductive fibers generally transverse to the network layers, such as, for example, in the electrooptic display 80 shown in FIG. 3. The electrooptic display 80 comprises two network layers 82 and 84 made of woven or knitted fibers 86, and a skeletal layer 88 made of filaments 90 interwoven with and connecting the network layers 82 and 84. Such 3-D structure is known in textiles manufacture as 3-dimensional spacer fabrics (SpaceTec(®, Duotex(®, 3 mesh®, etc.) and is produced in a single knitting process, whereby skeletal layers of different thickness may be obtained. Electrode structures 92 and 94 are created by weaving or knitting conductive fibers 92*a* to 92*d* and 94*a* to 94*d* into the network layers 82 and 84, respectively, either as additional fibers or as constituent fibers. Electrode structures may be also created by coating the knitted or woven network layers with conductive layers 98, or may include both conductive layers and conductive fibers. The skeletal layer 88 is impregnated with an EOA substance 96, forming, together with the electrode structures, an EOA zone similar to the zone described with reference to FIG. 1.

In each of the electrode structures 92 and 94, the conductive fibers (wires) are generally parallel to each other and separated from each other. The wires in the electrode structure 92 are transverse to the wires in the electrode structure 94. Thereby, the adjacent electrode structures 92 and 94 form, with the EOA substance therebetween, a matrix of EOA zones (pixels) 97. Each pixel is defined in the overlapping of a wire of the electrode structure 92 with a wire of the electrode structure 94. It will be appreciated that the size of such pixel is limited by the wires diameter and the thickness of the skeletal layer 88. The pixels are individually controllable. For example, the shown pixel 97 is activated when electric signal is applied to wires 92*a* and 94*a*. Thereby, a display structure is obtained that is capable of visualizing dynamic images such as running text, animation, TV sequence, movies, etc.

Figure 4:
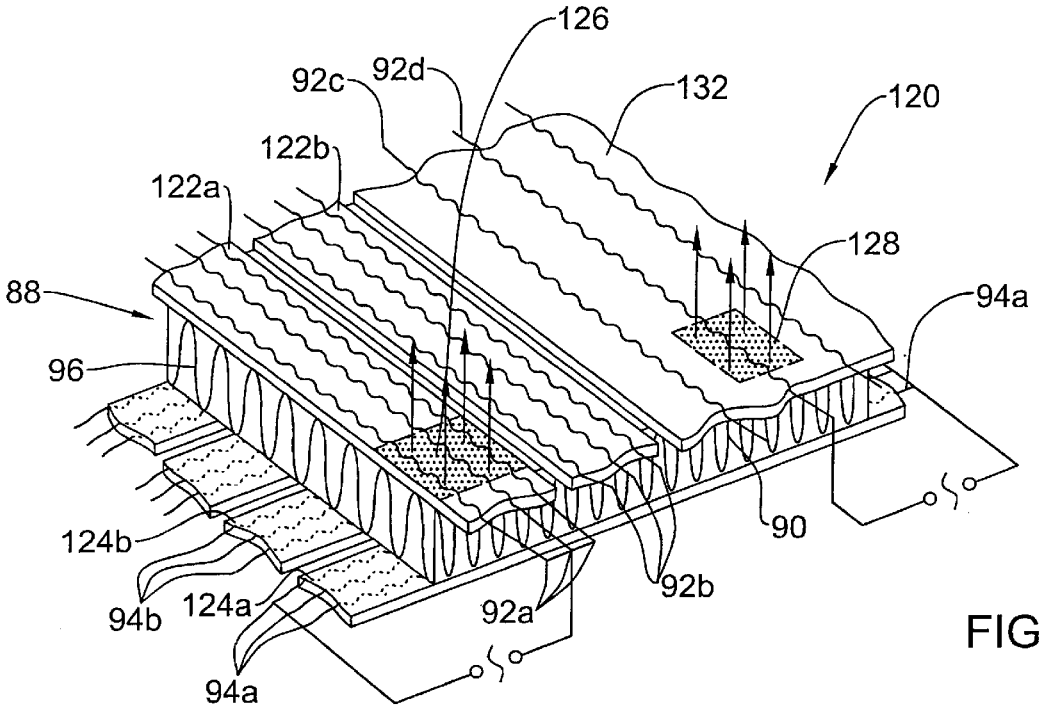
FIG. 4 is a perspective view of a matrix display structure with enlarged pixels in accordance with the present invention.

The electrooptic display 120 in FIG. 4 is similar to the one in FIG. 3 but has enlarged pixels. The display 120 comprises two network layers (not seen) made of woven or knitted fibers carrying electrode structures 92 and 94, and a skeletal layer 88 made of filaments 90 connecting and spacing apart the network layers. The skeletal layer is filled with EOA substance 96. The electrode structure 92 is covered with a transparent conductive layer laid in separated strips 122*a*, 122*b* generally parallel to the wires 92*a* to 92*d*. Each strip may be in contact with one or more wires. The electrode structure 94 is covered in a similar way by separated conductive strips 124*a*, 124*b* generally parallel to the wires 94*a* to 94*d* and transverse to the strips 122*a*, 122*b*. It will be appreciated that in this case a pixel 126 is defined in the overlapping of the strip 122*a* and the strip 124*a* and its dimensions are defined by the width of these strips.

Figure 5:
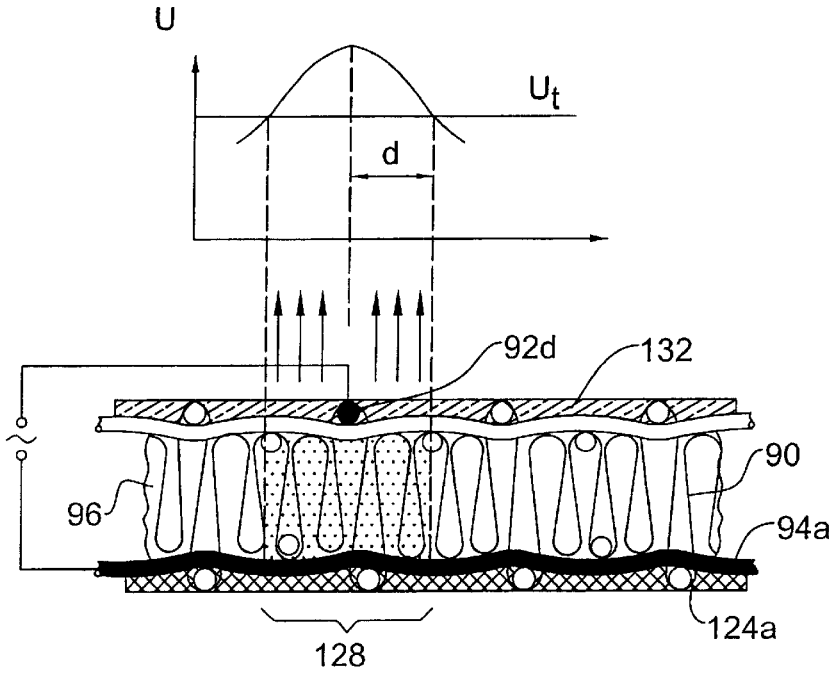
FIG. 5 is a schematic illustration of the operative electric voltage distribution in a display pixel.

The same effect is obtained by a continuous conductive layer 132 laid over the electrode structure 92, as also shown in FIG. 4. In this case, the conductivity of the layer 132 is limited in such a manner that the effective electric field at both sides of the conductive wire 92*d* falls under a threshold value at a predetermined distance d from the wire, thereby defining the size of pixel 128. The process is illustrated in the graph of FIG. 5 showing the distribution of the operative electric voltage U between the layer 132 and the strip 124*a* in the vicinity of the wire 92*d*, assuming that the EOA substance is electroluminescent. Light is emitted when and where this voltage exceeds a threshold value $U_t$. It will be appreciated that for a different EOA substance, a different characteristic of the electric field may be relevant, such as current, frequency, etc.

Instead of laying special layers of limited conductivity over the electrode structures, the network layers may be knitted or woven from fibers with limited conductivity, yielding the same effect of spreading the electric field in a predetermined vicinity of the conductive fibers (wires) 92 or 94.

Figure 6A:
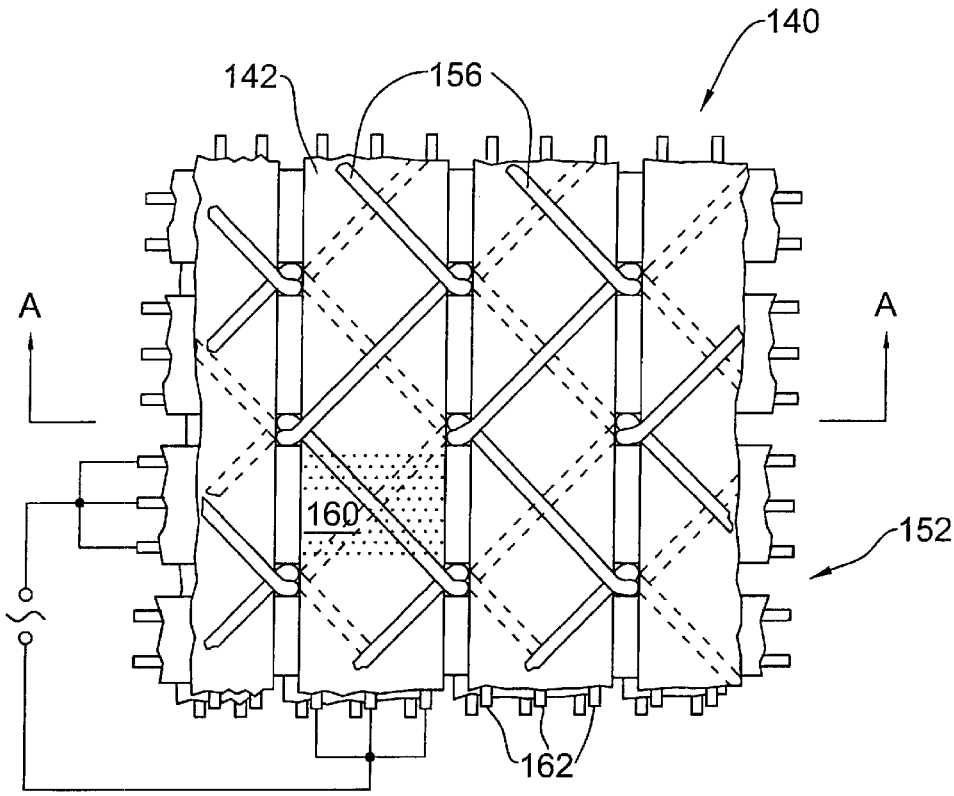
FIGS. 6A and 6B are a plan and a sectional view of a double-layered display structure in accordance with the present invention.
Figure 6B:
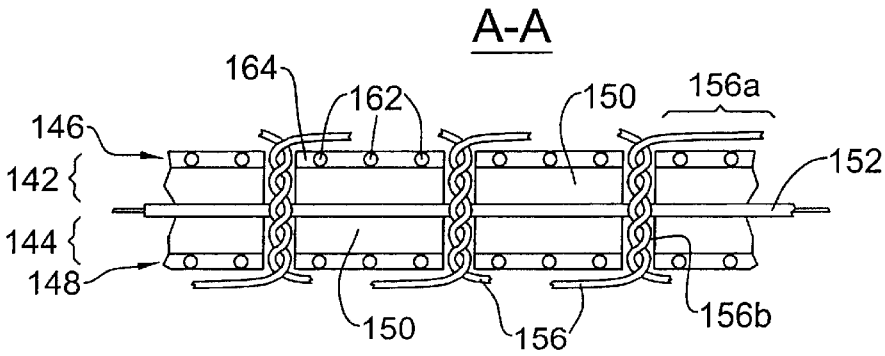

A different 3-D electrooptical display, according to the present invention, is shown in FIGS. 6A and 6B. The display 140 is assembled of longitudinal strips 142, comprising transparent or translucent conductive strips 146 and a layer of EOA substance 150, and transverse conductive strips 152. The flexible 3-D structure is knitted preferably from non-conductive fibers 156 which in this case belong in parts 156*a* to the network layers (at the surface), and in parts 156*b*, to the skeletal layer. It will be appreciated that EOA zones (pixels) 160 are formed at the overlapping of one longitudinal strip 142 with one transverse conductive strip 152. The display in FIGS. 6A and 6B is shown with a second set of longitudinal strips 144 under the transverse conductive strips 152, forming a second EOA layer. In this case either the conductive strips 148 or the transverse conductive strips 152 should be transparent. The conductive strips 146, 148 and 152 themselves may have various structure. For example, the strip 146 comprises conductive fibers 162 in a layer of limited conductivity 164, as described under number 132 in FIG. 5, or it may comprise conductive fibers interwoven in a network of non-conductive fibers.

Figure 7:
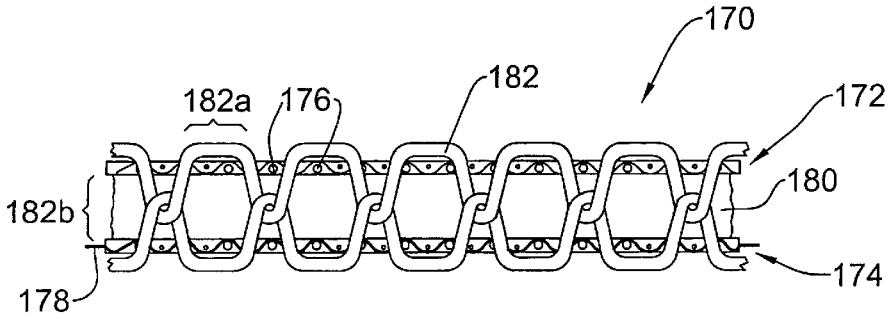
FIG. 7 is a sectional view of a sewn display structure in accordance with the present invention.

A similar electrooptic display 170 is shown in cross-section in FIG. 7. It comprises two fabric layers 172 and 174, for example woven or non-woven, or knitted, with conductive fibers 176 and 178, a layer of EOA substance 180 and a plurality of fibers 182 sewn through the above layers in stitches. The surface parts 182*a* of the fibers 182, together with the fabric layers 172 and 174, constitute network layers of the 3-D stricture, while the transverse parts 182*b* constitute the skeletal layer. In case the conductive fibers 176 and 178 form connected network electrode structures in the respective network layers, the display 170 will operate as the static image display 10 shown in FIG. 1. If the conductive fibers 176 and 178 are arranged in sets of parallel conductors, the two sets being transverse to each other, then a matrix of pixels will be obtained, similar to the one shown in FIG. 3. The pixels may be further enlarged by adding flexible layers of limited conductivity or conductive strips as shown in FIG. 4.

Figures 8A, 8B:
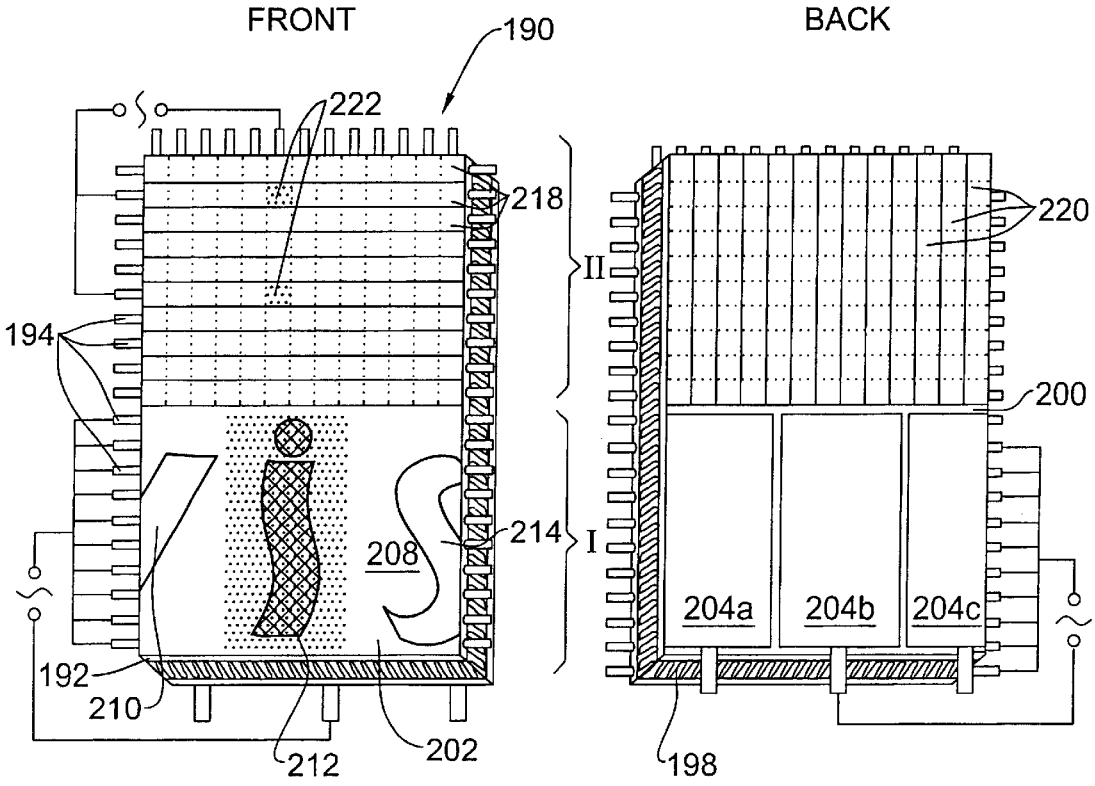
FIGS. 8A and 8B are front and back plan views of a combined electro-optical display structure in accordance with the present invention.

With reference to FIGS. 8A (front view) and 8B (back view), an electrooptic display 190 is presented, combining a static and a dynamic display in one unit. The combined display 190 comprises a front network layer 192 with electrode structure of wires 194, a skeletal layer 198 filled with EOA substance, and a back network layer 200. A transparent conductive layer 202 covers the front electrode structure 194, and a second conductive layer 204 covers the back network layer 200.

The display 190 is divided into two or more areas of two kinds. The area I is organized in a manner similar to FIG. 2: a layer of EOA substance is laid in separated areas or in areas of different electro-optic properties 208, 210, 212, and 214. The transparent conductive layer 202 covers the area I as one continuous area, while the second conductive layer 204 is laid in separated areas 204*a*, 204*b*, 204*c*. Thereby, the area I constitutes a display with a number of static pictures.

The area II is organized in a manner similar to FIG. 4. The transparent conductive layer 202 is laid in longitudinal strips 218 parallel to the conductive wires 194, in electric contact with them. The second conductive layer 204 is laid in strips 220 transverse to the longitudinal conductive strips 218. Thereby, a dynamic matrix of individually controllable pixels 222 is formed in the area II. The EOA substance in the area II may be uniform, yielding a monochromatic matrix display, or the pixels may have different colors, yielding a color display. Thus, one flexible display may contain both static pictures such as logos, decorative luminous panels, and dynamic images such as animation and/or running text.

Figure 9:
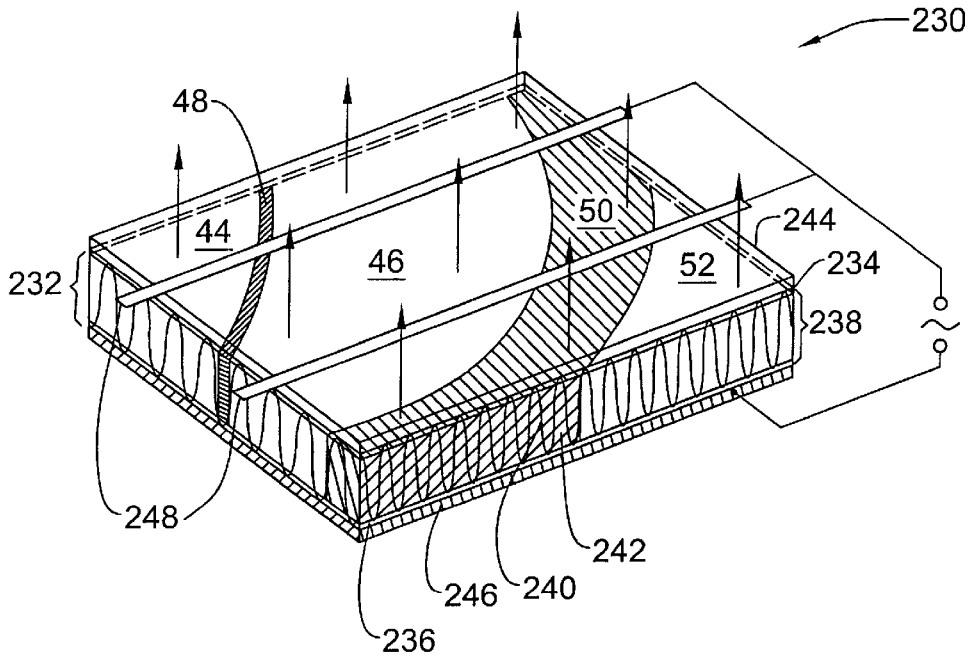
FIG. 9 is a perspective view of another generalized 3-D structure of an electro-optical display of the present invention.

The electrode structures of the displays of the present invention are not necessarily supported by network layers. Thus, FIG. 9 shows in a perspective sectional view a generalized electrooptic display design 230 comprising a flexible three-dimensional structure 232 built of a front transparent layer 234 and back layer 236 made of flexible polymer film, and a skeletal layer 238 formed of fibers 240, having empty space 242. Fibers of the skeletal layer are bonded or welded or otherwise connected to the film layers 234 and 236.

The film layers 234 and 236 carry conductive electrode layers 244 and 246 bonded thereto. The front electrode layer 244 is transparent and may also comprise thin narrow conductive strips 248.

The empty space 242 of the skeletal layer 238 is filled with EOA substance. Thus, an EOA zone is formed between the electrode layers 244 and 246. The display 230 operates in the same way as the one described with reference to FIG. 1, hence the same numerals are used hereafter.

The EOA substance in the skeletal layer 238 may be laid as areas 44 and 46 separated by gaps 48 filled with optically inactive substance, or as areas 46, 50 and 52 having different electro-optic properties, for example, different color. These areas represent distinctive display elements forming a static image when a suitable electric signal is applied to the electrode layers 244 and 246.

Figure 10:
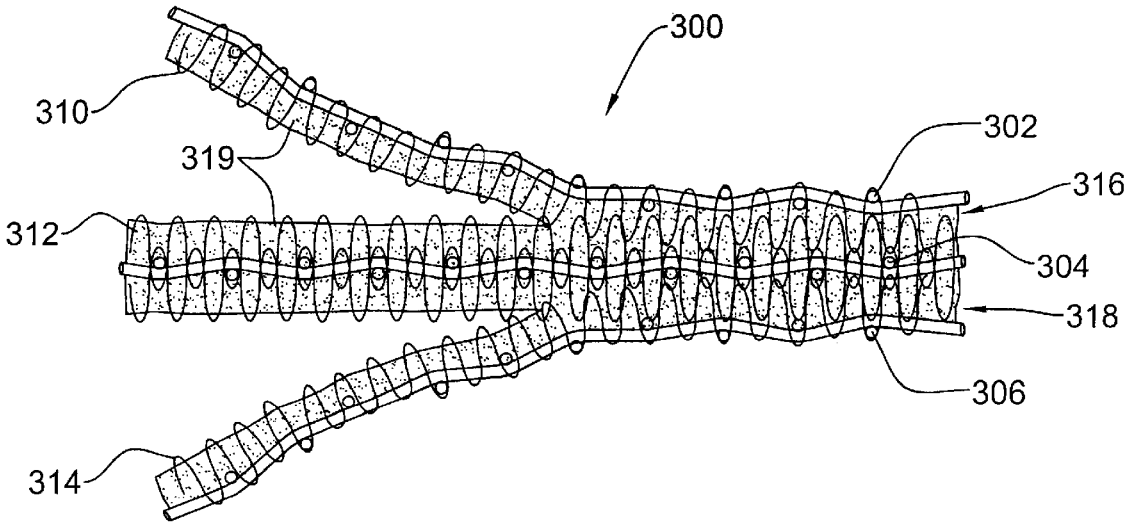
FIG. 10 is a schematic sectional view of an electro-optical display structure based on a Velcro-like fabric.

According to the present invention, another type of 3-D electrooptic display 300, shown by sectional view in FIG. 10, may be obtained from network layers 302, 304 and 306 which are formed from a plurality of woven or knitted fibers as in FIGS. 1, 3 and 4. However, in each network layer, there are interwoven non-conductive fibers 310, 312 and 314 protruding from one or both sides of the network layer in the form of Velcro hooks and loops or plush pile. Skeletal layers 316 and 318 are formed by the hooks and loops or pile of two adjacent network layers snapped together. In this case, the EOA substance 319 may be impregnated into the skeletal layers before assembling the display structure.

Although a description of specific embodiments has been presented, it is contemplated that various changes could be made without deviating from the scope of the present invention. For example, display structures shown here with one or two skeletal layers may be complemented with more skeletal layers and respective network layers and electrode structures.

What is claimed is:

1. An electro-optical display comprising:

a flexible three-dimensional structure including at least two layers of electrode structures, said layers being held together but spaced apart by at least one skeletal layer formed of fibers transverse to said electrode structures, said skeletal layer having empty space among said transverse fibers; and an electrooptically active (EOA) substance at least partially filling the empty space of said skeletal layer, whereby an electrooptically active zone (EOA zone) is formed by said EOA substance between said electrode structures.

2. An electro-optical display according to claim 1, further comprising at least one network layer made of fibers, said network layer carrying one of said electrode structures.

3. An electro-optical display according to claim 1, further comprising at least one flexible film layer, said film layer carrying one of said electrode structures.

4. An electro-optical display according to claim 2, wherein the fibers forming said skeletal layer are interwoven with said network layer.

5. An electro-optical display according to claim 4, wherein parts of the fibers forming said skeletal layer constitute a part of said network layer.

6. An electro-optical display according to claim 2, wherein said network layer is formed of at least one of the following:

a plurality of fibers overlapping each other;

a plurality of woven fibers;

a plurality of non-woven fibers; and a plurality of knitted fibers.

7. An electro-optical display according to claim 1, wherein at least one of said electrode structures is formed of at least one of the following:

a flexible conductive layer; and a plurality of conductive fibers.

8. An electro-optical display according to claim 1, wherein said EOA zone comprises a plurality of distinctive display elements defining an image.

9. An electro-optical display according to claim 8, wherein said display elements are formed by separated areas of EOA substance or by areas of EOA substance with different electro-optic properties.

10. An electro-optical display according to claim 8, wherein at least one of the electrode structures is formed from separated areas with individual wiring, said display elements being formed by the EOA substance between said areas and a second electrode structure.

11. An electro-optical display according to claim 2, wherein at least one of said network layers is formed from a plurality of woven or knitted fibers, at least one of said electrode structures comprises a plurality of conductive fibers, and said conductive fibers are interwoven with the fibers of said network layer.

12. An electro-optical display according to claim 1, wherein at least one of said two electrode structures comprises a first set of conductive fibers extending in parallel directions.

13. An electro-optical display according to claim 12, wherein the other of said two electrode structures comprises a second set of conductive fibers extending in parallel directions and transverse to the conductive fibers of the first set, whereby said EOA zone is constituted by a matrix of individually controllable EOA zones (pixels), each defined in an overlapping of a conductive fiber of the first set with a conductive fiber of the second set.

14. An electro-optical display according to claim 12, wherein said at least one electrode structure further comprises a conductive transparent or translucent layer in contact with said first set of conductive fibers, in one of the following forms:

a) in the form of first separated strips parallel to said first conductive fibers, each strip being in contact with at least one conductive fiber; or b) in the form of a continuous layer of predetermined limited conductivity, such that the effective electric field of each conductive fiber of the first set is expanded over a first strip of predetermined width disposed along said fiber.

15. An electro-optical display according to claim 14, wherein the second of said two electrode structures comprises a second set of conductive fibers extending in parallel directions and transverse to the fibers of the first set, and a conductive layer in contact with said second set of conductive fibers, in one of the following forms:

a) in the form of second separated strips parallel to said second set of conductive fibers, each strip being in contact with at least one conductive fiber; or b) in the form of a continuous layer of predetermined limited conductivity, such that the effective electric field of each conductive fiber of the second set is expanded over a second strip of predetermined width disposed along said fiber, thereby forming a matrix of individually controllable EOA zones (pixels), each pixel being defined in an overlapping of a strip of the first set with a strips of the second set.

16. An electro-optical display according to claim 2, wherein said network layers are formed from a plurality of woven or knitted fibers, in each network layer are interwoven fibers protruding from one or both sides thereof in the form of Velcro hooks and loops or plush pile, and said skeletal layer is formed by the hooks and loops or the pile of two network layers snapped together.

17. A three-dimensional spacer fabric comprising at least two woven or knitted network layers being held together but spaced apart by at least one skeletal layer made of fibers at least partly transverse to said network layers and interwoven therewith wherein at least a first one of said network layers comprises a first set of conductive fibers.

18. A three-dimensional spacer fabric according to claim 17, wherein said first set of conductive fibers forms a conductive network.

19. A three-dimensional spacer fabric according to claim 17, wherein said conductive fibers of said first set of are spaced from each other and extend in parallel directions.

20. A three-dimensional spacer fabric according to claim 19, wherein a second of said network layers comprises a second set of conductive fibers which are spaced from each other, extend in parallel directions, and are transverse to the conductive fibers of said first set.

21. A three-dimensional spacer fabric according to claim 19, wherein at least said first network layer further comprises a second set of conductive fibers transverse to and in contact with said first set, the fibers of said second set having a lower predetermined conductivity than the fibers of said first set.

* * * * *